US008297641B2

(12) United States Patent
Landry et al.

(10) Patent No.: US 8,297,641 B2
(45) Date of Patent: Oct. 30, 2012

(54) SEAT SUPPORTING ASSEMBLY AND WHEELCHAIR INCLUDING SAME

(76) Inventors: Carmon Landry, Ile Perrot (CA); Eric Dugas, Rigaud (CA)

( * ) Notice: Subject to any disclaimer, the term of this patent is extended or adjusted under 35 U.S.C. 154(b) by 629 days.

(21) Appl. No.: 12/083,698

(22) PCT Filed: Oct. 17, 2006

(86) PCT No.: PCT/CA2006/001702

§ 371 (c)(1),
(2), (4) Date: Apr. 17, 2008

(87) PCT Pub. No.: WO2007/045083

PCT Pub. Date: Apr. 26, 2007

(65) Prior Publication Data

US 2009/0230652 A1 Sep. 17, 2009

(51) Int. Cl.
*A61G 5/14* (2006.01)
*A61G 5/04* (2006.01)

(52) U.S. Cl. ..... 280/647; 280/200; 280/250.1; 280/304.1; 280/638; 280/650; 280/47.38; 280/47.41; 297/330

(58) Field of Classification Search ..... 280/200, 280/288.4, 304.1, 638, 647, 650, 657, 658, 280/47.38, 47.4, 47.41; 297/327, 328, 330, 297/334

See application file for complete search history.

(56) References Cited

U.S. PATENT DOCUMENTS

| | | | | |
|---|---|---|---|---|
| 4,093,178 | A * | 6/1978 | Hughes et al. | 251/104 |
| 5,774,914 | A * | 7/1998 | Johnson et al. | 5/602 |
| 6,357,776 | B1 * | 3/2002 | Goertzen et al. | 280/304.1 |
| 2002/0166884 | A1 * | 11/2002 | Luo | 227/131 |
| 2008/0061261 | A1 * | 3/2008 | Weston et al. | 251/305 |

* cited by examiner

*Primary Examiner* — Jeffrey J Restifo
*Assistant Examiner* — Bryan Evans

(57) ABSTRACT

A seat supporting assembly (24) for supporting a seat (18), the assembly comprising a base (25) including a substantially elongated guiding rod (58), a seat support (36), a seat support-to-base linking member (56) pivotally coupled to the seat support (36) and sliding on the base guiding rod (58), a substantially elongated tilting member (60) having a guiding groove (66) and being pivotally attached to the seat support (36) and to the base (25). An actuating assembly (44) is coupled to the base (25) and includes a motion transmitting member (68) mounted within the guiding groove (60). The force from the actuating assembly moves the tilting member (60) according to the geometry of the guiding groove (66), which causes the seat supporting assembly (24) to move between tilted and upright configurations by pivoting the tilting member (60) relative to the seat support (36) and the base (25) and substantially simultaneously moving the seat support-to-base linking member (56) longitudinally relative to the guiding rod (58). The assembly is designed to maintain the location of the center of gravity of a user as the seat tilts rearwardly by automatically moving the seat forwardly during tilting. The guiding groove (66) in the tilting member (60) may be curved such that the tilting motion occurs with a constant angular velocity The seat assembly is particularly useful for wheelchairs.

17 Claims, 7 Drawing Sheets

18
10
22
20
36
26
25
16
14

SEAT SUPPORTING ASSEMBLY AND WHEELCHAIR INCLUDING SAME

FIELD OF THE INVENTION

The present invention relates to the general field of mobility assistance and is particularly concerned with a seat supporting assembly and a wheelchair including same.

BACKGROUND OF THE INVENTION

Wheelchairs have been used for many years in order to provide assistance in transportation of handicapped persons. In some cases, the handicapped person may be a paraplegic or a quadriplegic. In such cases, the wheelchair constitutes an invaluable source of individual transportation.

Whether manually operated or motor-driven, wheelchairs typically include a wheel-supported base for rollably supporting a seat. The seat, in turn, typically includes a bottom portion for supporting the gist of the weight of the intended user and a backrest portion for supporting the back of the intended user. Over the passed recent years, powered wheelchairs in particular have incorporated various features aimed at assisting the handicapped individual in his or her pursuit of independent operation and movement. Accordingly, some individuals, such as paraplegics and quadriplegics may spend a considerable amount of time sitting in their wheelchairs.

One of the major problems encountered by wheelchair users, especially paraplegics and quadriplegics, is the necessity to shift or move the body weight with respect to the support provided by the wheelchair. Indeed, the continuous pressure of the body's weight on certain specific locations of the body such as that provided by the skeletal structure causes the supporting skin to lose circulation.

If a person sits in the same position in a wheelchair for a long period of time, pressure is continuously applied to the tissue on the buttocks, legs and/or back that is bearing the person's weight in that position. This not only leads to discomfort and even pain but may also lead to medical complications such as sores, ulcers or the like.

In order to provide shifting of their body weight from time to time, some paralysed individuals may have to resort to using a nurse or attendant to manually tilt the entire wheelchair or the seat portion of the latter backwards so that the occupant's weight is shifted and the pressure points on the occupant's body is moved. However, body weight shifting is recommended at intervals of at least every 20 minutes.

This may prove to be a considerable task for a nurse or attendant. Furthermore, it would be more desirable to provide the wheelchair user with a means to make this shift of position on their own without assistance from an attendant.

It would, hence, be desirable to provide a reclining wheelchair in which the seat of the wheelchair is pivotally supported on the base of the wheelchair. The pivoting of an occupant with respect to the base would facilitate blood circulation, thereby providing relief for the occupant.

To address this problem, wheelchairs are sometimes provided with a movable pivot point upon which the wheelchair seat is mounted. Typically, a linear-type actuator is provided to raise the front end of the seat and tilt the seat back. However, prior art structures typically suffer from numerous drawbacks. One such drawback is that some prior art structures require the seat of the wheelchair be elevated to meet this demand since the actuating mechanism and associated linkage structures are relatively bulky. Wheelchair occupants typically disfavor this increase in elevation of the seat.

Another disadvantage associated with some prior art wheelchair tilting assemblies is that their configuration is such that, as the seat is reclined, the center of gravity for the occupied wheelchair shifts rearwardly. This shift of the center of gravity increases the tendency of the wheelchair towards rearward overturn. A significant shift in the center of gravity may even result in an unstable condition in which the force of gravity alone acting on the occupant is sufficient to overturn the wheelchair.

Accordingly, there exists a need in the industry for an improved seat supporting assembly and wheelchairs including same.

OBJECT OF THE INVENTION

An object of the present invention is therefore to provide an improved seat supporting assembly and wheelchairs including same.

SUMMARY OF THE INVENTION

In a first broad aspect, the invention provides a seat supporting assembly for supporting a seat, the seat supporting assembly comprising:

a base, the base including a substantially elongated base guiding member;

a seat support for supporting the seat;

a seat support-to-base linking member, the seat support-to-base linking member being operatively coupled to the seat support and to the base guiding member with the seat support being tiltable relatively to the base and the seat support-to-base linking member being substantially longitudinally movable relatively to the base guiding member;

a substantially elongated tilting member defining a tilting member first end section, a substantially longitudinally opposed tilting member second end section and a tilting member intermediate section extending therebetween, the tilting member intermediate section defining a guiding groove extending generally longitudinally relatively to the tilting member, the tilting member first end section being pivotally attached to the seat support in a substantially spaced apart relationship relatively to seat support-to-base linking member, the tilting member second end section being pivotally attached to the base; and an actuating assembly operatively coupled to the base and to the tilting member for moving the seat supporting assembly between an upright configuration and a tilted configuration, a seat support-to-base angle between the seat support and the base being larger in the tilted configuration than in the upright configuration, the actuating assembly including a motion transmitting member mounted to the guiding groove so as to be substantially slidably movable relatively thereto, the motion transmitting member being movable relatively to the base along a predetermined path;

wherein moving the motion transmitting member along the predetermined path slides the motion transmitting member relatively to the guiding groove, which causes the seat supporting assembly to move between the tilted and upright configurations by pivoting the tilting member relatively to the seat support and the base and substantially simultaneously moving the seat support-to-base linking member substantially longitudinally relatively to the base guiding member.

Advantages of the present invention include that the proposed seat supporting assembly is usable to support a seat, such as for example the seat of a wheelchair, so that the seat is reclinable and therefore allows an occupant thereof to independently and ergonomically pivot the seat of the wheelchair relative to its base. The proposed seat supporting assembly is designed so as to be relatively compact so as to reduce the need for increasing the spacing between the base of the wheelchair and the seat of the wheelchair.

Furthermore, the proposed seat supporting assembly is designed so as to reduce shifting of the center of gravity of the wheelchair as the seat is pivoted relative to its base, hence reducing the risk of the wheelchair being overturned by gravity.

Still furthermore, the proposed seat supporting assembly is designed so as to provide a relatively smooth pivoting motion with a relatively constant rotational speed throughout the pivotal range of motion.

Yet, still furthermore, the proposed seat supporting assembly is designed so as to be relatively mechanically simple, hence providing a structure that will be relatively reliable and require minimal maintenance. Also, the proposed seat supporting assembly is designed so as to be manufacturable using conventional forms of manufacturing so as to provide a seat supporting assembly that will be economically feasible.

In another broad aspect, the invention provides a tiltable seat assembly, the tiltable seat assembly comprising the proposed seat supporting assembly and a seat mounted to the seat supporting assembly.

In yet another broad aspect, the invention provides a wheelchair for supporting an intended user, the wheelchair comprising:

a wheelchair frame;

at least three wheels rotatably mounted to the wheelchair frame;

the proposed seat supporting assembly attached to the wheelchair frame; and a seat mounted to the proposed seat supporting assembly.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
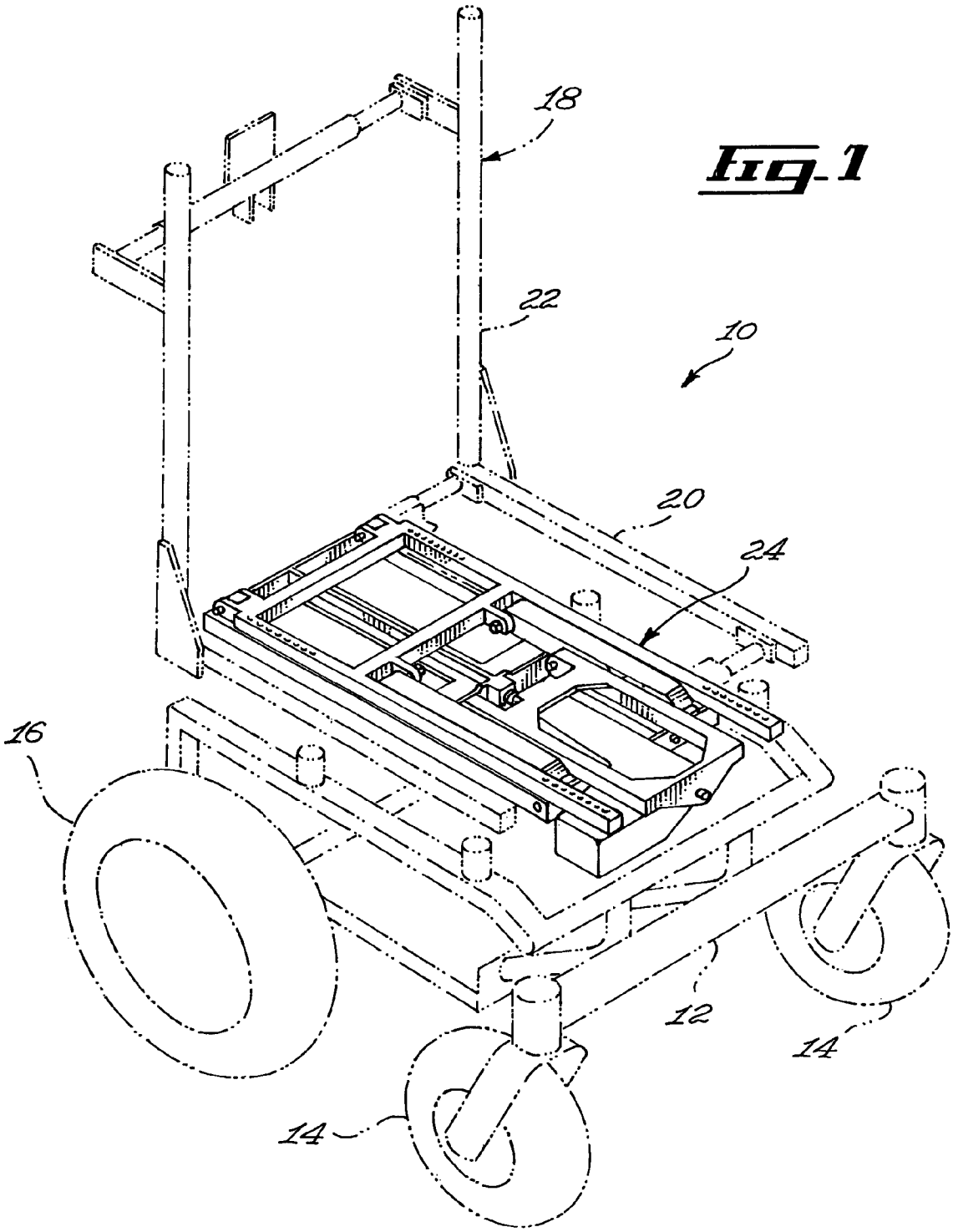
FIG. 1, in a front perspective view, illustrates a wheelchair in accordance with an embodiment of the present invention, the wheelchair including a seat supporting assembly supporting a seat, the seat being partially shown in phantom lines, the seat supporting assembly being shown in an upright configuration.

Referring to FIG. 1, there is shown a wheelchair in accordance with an embodiment of the present invention, generally indicated by the reference numeral 10. The wheelchair 10 typically includes a wheelchair frame, also referred to as a wheelchair base, shown in phantom lines and generally indicated by the reference numeral 12. At least three wheels are rotatably mounted to the wheelchair frame 12, the at least three wheels define a sustentation polygon. In the specific embodiment of the invention shown in the drawings, the wheelchair frame 12 is rollably mounted on a pair of front wheels 14 and a pair of rear wheels 16.

The wheel chair 10 also includes a seat generally indicated by the reference numeral 18. The seat 18 includes a seat frame defining a bench section 20 and a backrest section 22. The bench and backrest sections 20, 22 are adapted to support cushioning means (not shown in the drawings) for respectively bearing the gist of the weight of the intended user and acting as a backrest for the latter.

Figure 2:
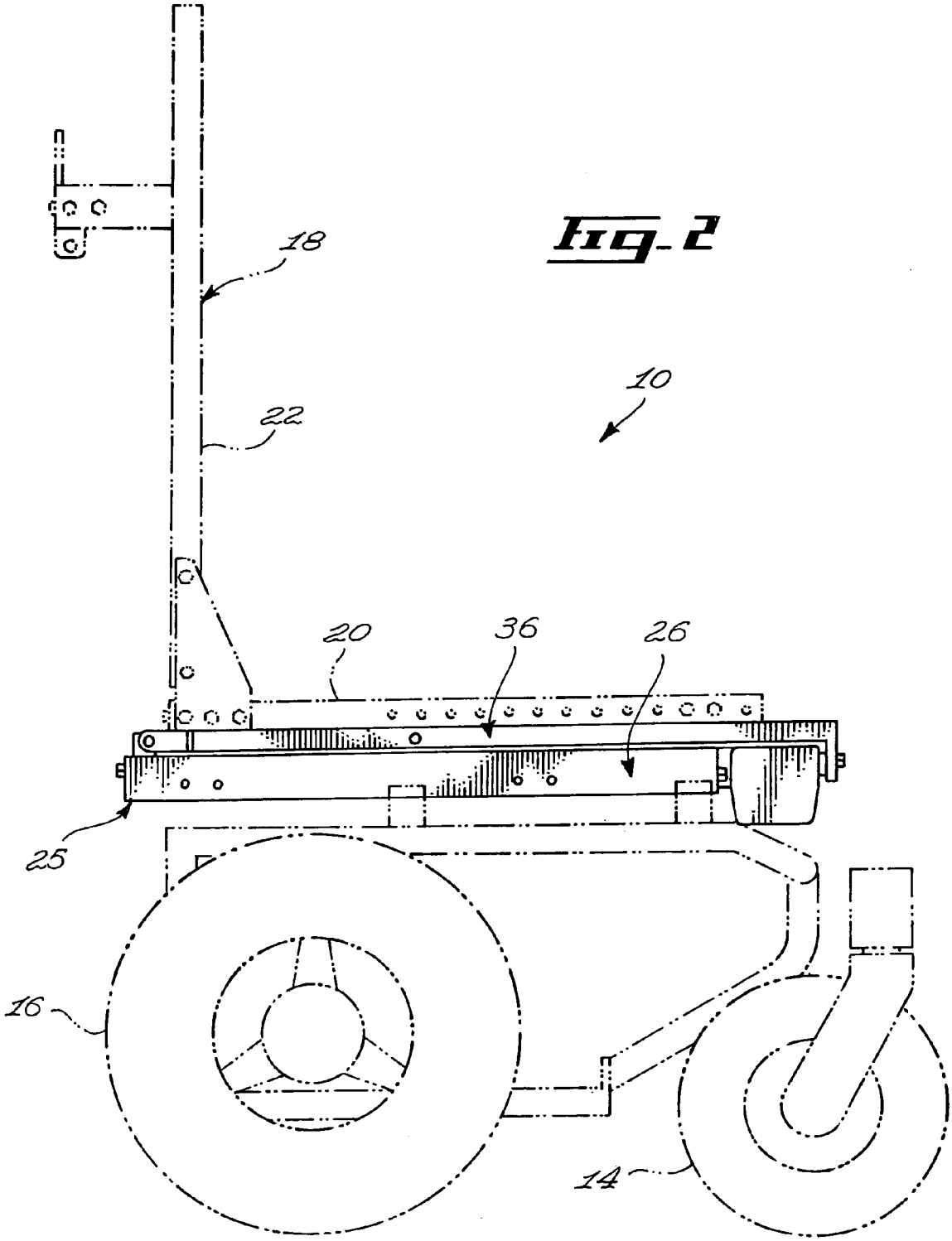
FIG. 2, in a side elevational view, illustrates the wheelchair shown in FIG. 1 with its seat supporting assembly in an upright configuration.
Figure 3:
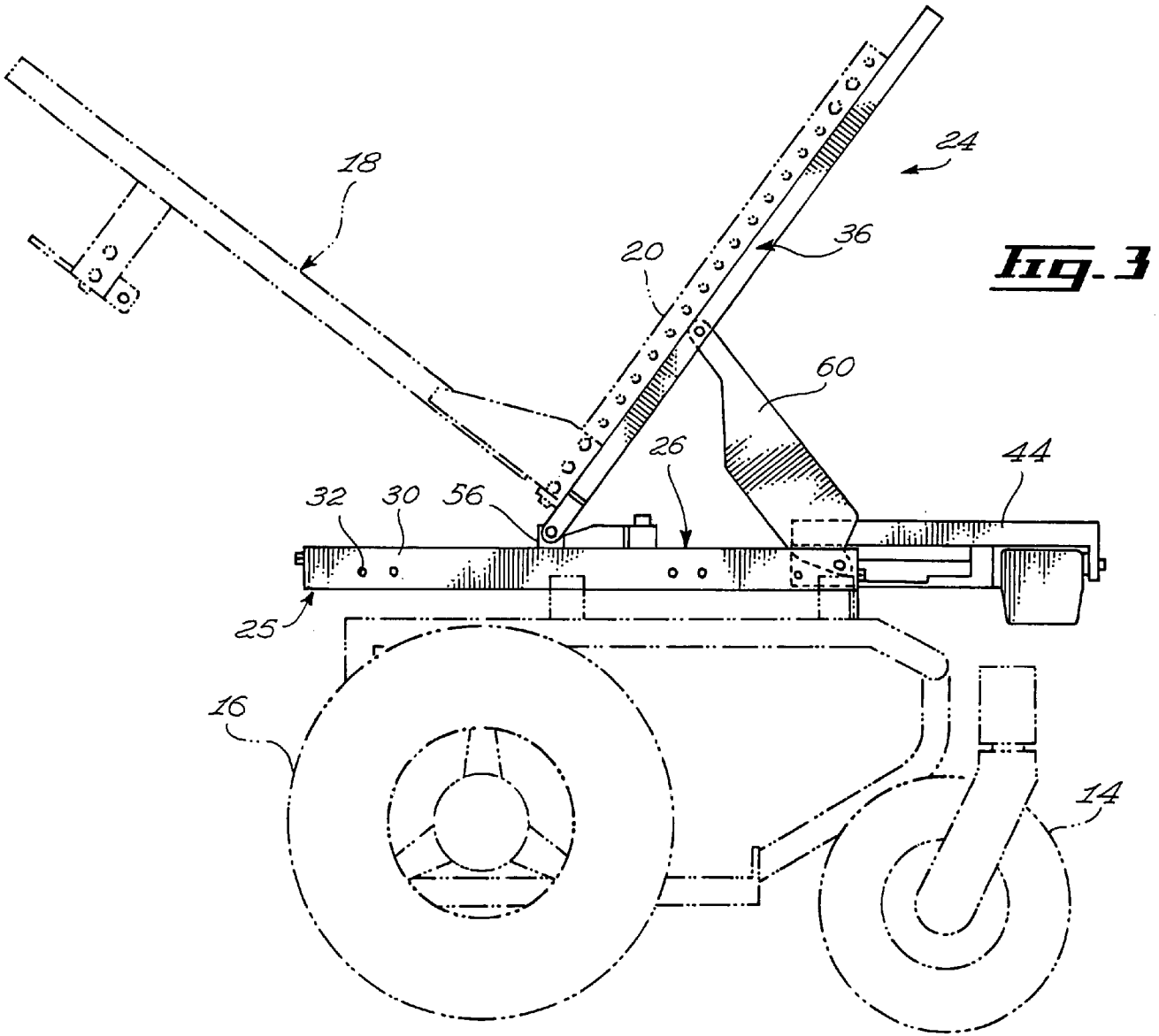
FIG. 3, in a side elevational view, illustrates the wheelchair shown in FIGS. 1 and 2 with its seat supporting assembly in the tilted configuration.
Figure 4:
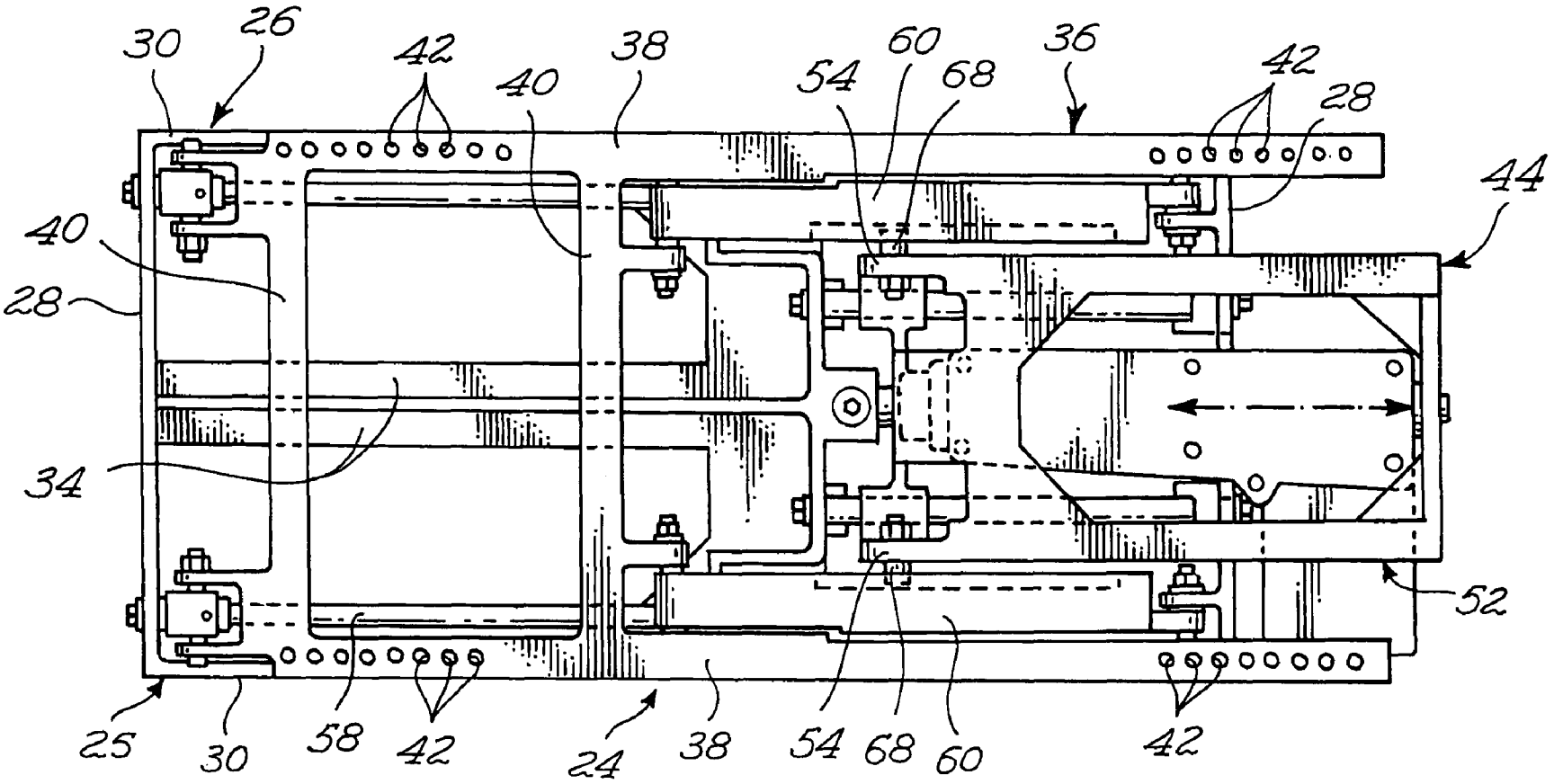
FIG. 4, in a top plan view, illustrates the seat supporting assembly shown in FIGS. 1 through 3 with the seat supporting assembly in the upright configuration.
Figure 5:
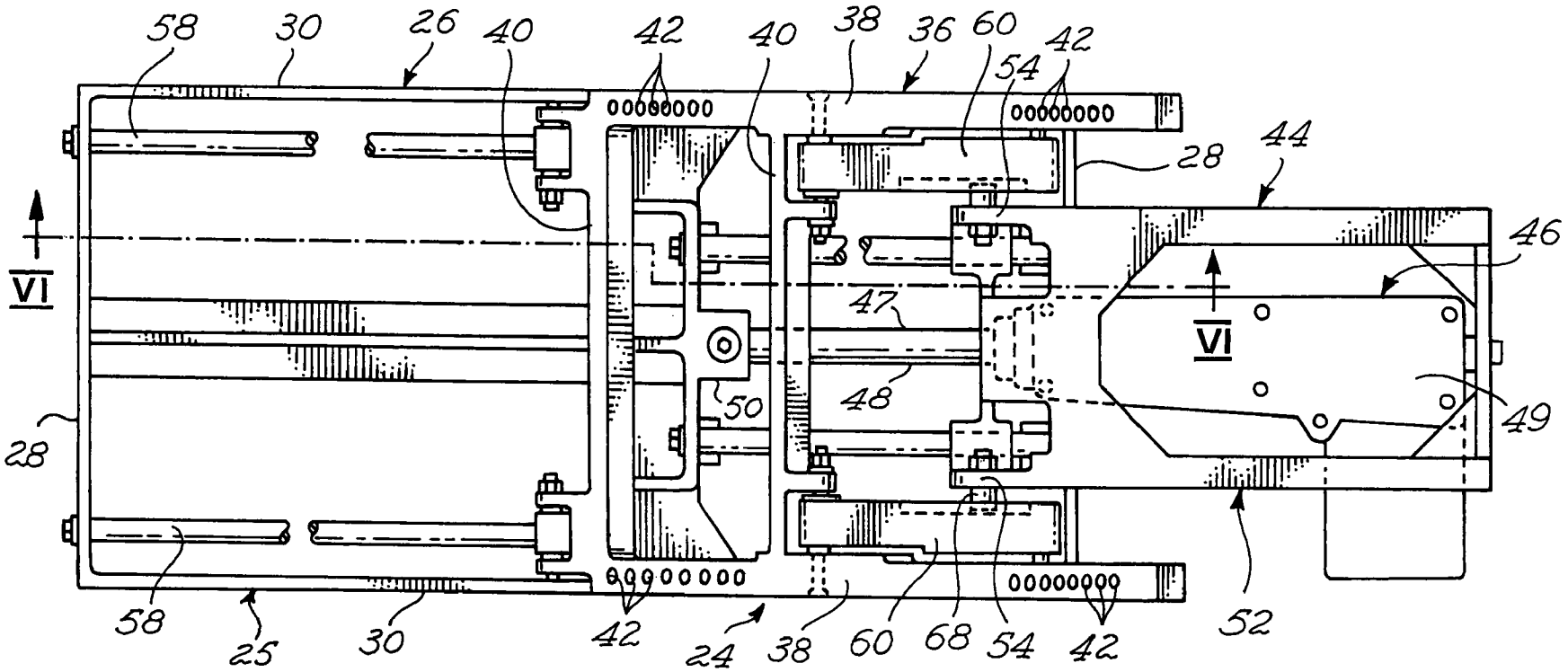
FIG. 5, in a top plan view, illustrates the seat supporting assembly shown in FIGS. 1 through 4 with the seat supporting assembly in the tilted configuration.
Figure 6:
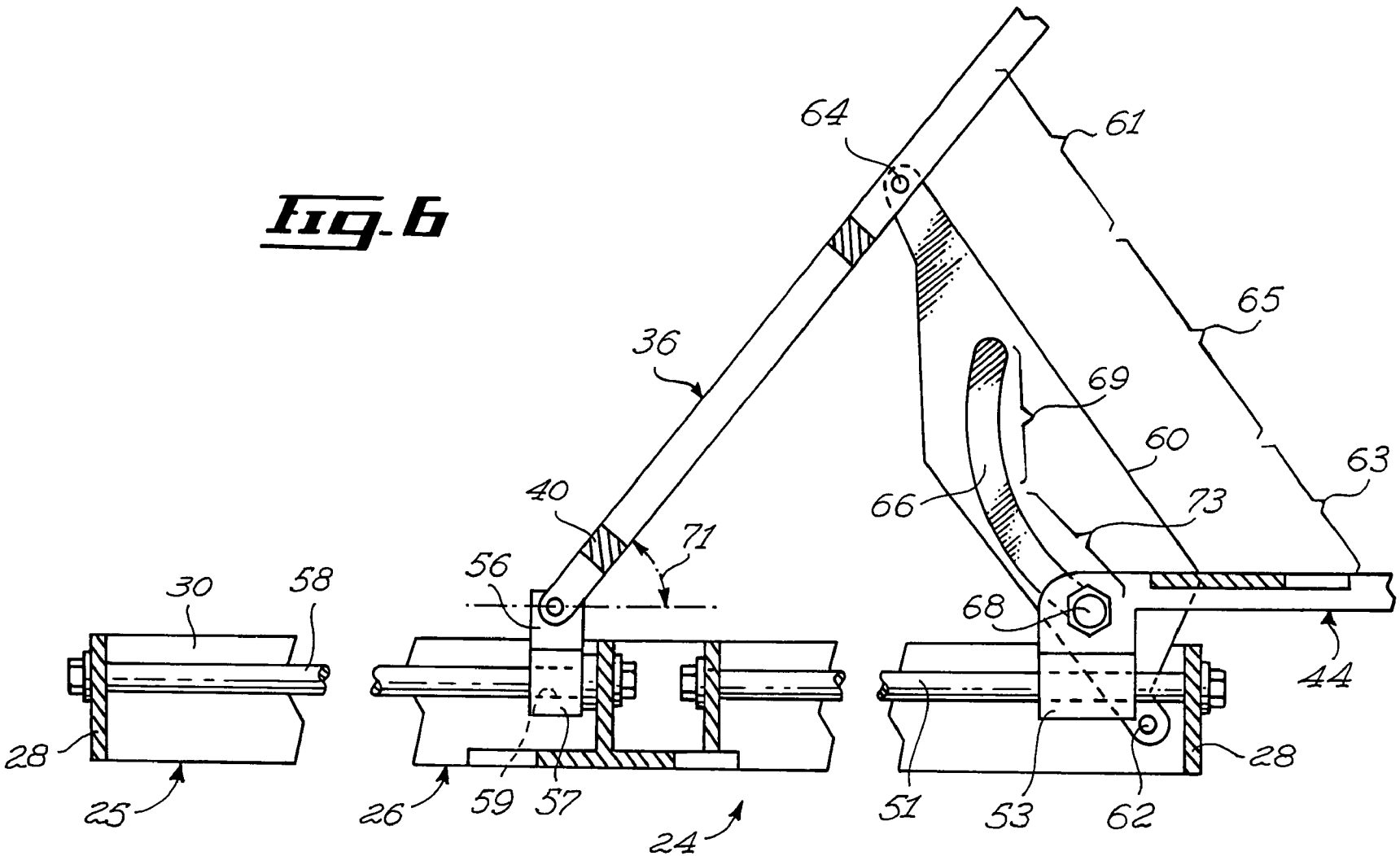
FIG. 6, in a side cross-sectional view, illustrates the seat supporting assembly shown in FIGS. 1 through 5 with the seat supporting assembly in the tilted configuration.

The wheelchair 10 further includes a seat supporting assembly generally indicated by the reference numeral 24 for mounting the seat 18 thereto and for pivoting the seat 18 between an upright configuration shown in FIGS. 1, 2 and 4 and a tilted configuration shown in FIGS. 3, 5 and 6. The seat supporting assembly 24 is mounted to the wheelchair frame 12 and operatively coupled to the seat 18. It should be understood that the wheelchair frame 12, its associated set of wheels 14, 16 and the seat 18 shown throughout the drawings are only illustrated by way of example and that the wheelchair frame 12 and the seat 18 could vary in configuration, size and other parameters without departing from the scope of the present invention.

Referring now more specifically to FIGS. 2 through 7, there is shown in greater details some of the features of the seat supporting assembly 24. The seat supporting assembly 24 includes a base 25, the base 25 including a base frame generally indicated by the reference numeral 26. The base frame 26 is adapted to be secured to the wheelchair frame 12 by suitable fastening means.

Referring to FIGS. 4 and 5, in the embodiment shown throughout the drawings, the base frame 26 includes a pair of longitudinally opposed base frame end walls 28 and a pair of transversally opposed base frame peripheral walls 30. The base frame peripheral walls 30 are provided with attachment apertures 32 extending therethrough, as better seen in FIG. 3. The attachment apertures 32 may be used for securing the base frame 26 to the wheelchair frame 12 using conventional fastening means such as screws, bolts, rivets or the like. The base frame 26 typically further includes a base frame reinforcement members 34 for improving the structural rigidity of the seat supporting assembly 24. For example, the base frame reinforcement member 34 is substantially T-shaped and is secured to one of the base frame end walls 28 and to the two base frame peripheral walls 30. This configuration of the frame reinforcement member 34 is relatively lightweight and allows to reinforce the base frame 26 without unduly increasing its height.

Figure 7:
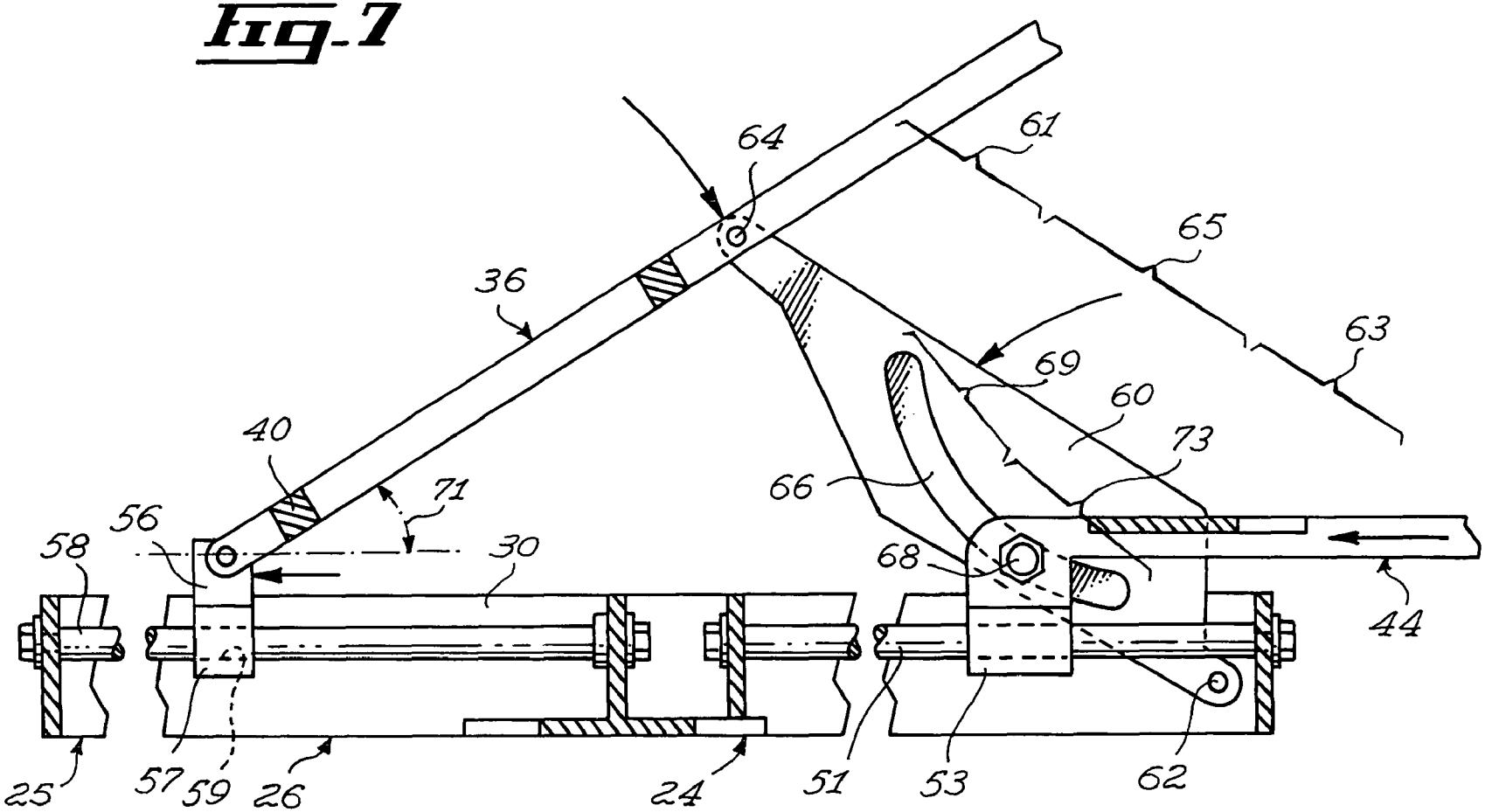
FIG. 7, in a side cross-sectional view, illustrates the seat supporting assembly shown in FIGS. 1 through 6 with the seat supporting assembly in a configuration intermediate the tilted and upright configurations.

The seat supporting assembly 24 also includes a seat support generally indicated by the reference numeral 36. The seat support 36 is adapted to be secured to the seat 18 of the wheelchair 10 for selectively inducing the pivotal movement thereof. As seen in FIGS. 6 and 7, a seat support-to-base angle 71 between the seat support 36 and the base 25 is larger in the tilted configuration than in the upright configuration In the embodiment shown throughout the Figures, the seat support 36 includes a pair of elongated pivoting members 38 maintained in a spaced apart relationship relative to each other by two substantially longitudinally spaced apart transversal rods 40. The pivoting members 38 are typically provided with attachment apertures 42 extending therethrough adapted to be used for attachment to the bench component 20 of the seat 18 by conventional fastening means such as screws, bolts, rivets or the like. It should be understood that both the base frame 26 and the seat support 36 could vary in shape, configuration, size and construction without departing from the scope of the present invention.

The seat supporting assembly 24 further includes an actuating assembly, generally indicated by the reference numeral 44, and substantially elongated tilting members 60 both for together pivoting the seat support 36 relative to the base frame 26. As better seen in FIG. 5, the actuating assembly 44 typically includes an actuator, such as a linear-type actuator 46. The linear-type actuator 46 may be of any suitable type such as the endless screw type or the like. The linear actuator 46 includes an actuator piston or rod 48 adapted to be selectively extended and retracted. The distal end of the actuator piston or rod 48 is solidly anchored to an anchoring wall 50 extending across the base frame 26. The body of the linear-type actuator 46 is secured to an actuating assembly frame generally indicated by the reference numeral 52.

The actuating assembly frame 52 is, in turn, slidably mounted to the base frame 26 for substantially longitudinal slidable movement relative thereto. In other words, the actuating assembly frame 52 is mounted to the base 25 so as to be movable relatively thereto over a substantially rectilinear path. Typically, the actuator mounting frame 52 includes a pair of actuator mounting bracket longitudinal arms 54. The actuator bracket longitudinal arms 54 are each provided with a corresponding sliding cursor or block 53 adjacent a longitudinal end thereof, each of the sliding cursors 53 being slidably mounted to a respective guiding rod 51 extending, at least partially, longitudinally across the base frame 26. For example, the guiding rods 51 each extend between the anchoring wall 50 and a base frame end wall 28.

The linear-type actuator 46 includes first and second end portions 47 and 49, the actuator first and second end portions 47 and 49 being attached respectively to the base 25 and to the actuating assembly frame 52. The linear-type actuator 46 is selectively movable between a retracted configuration, shown in FIG. 4, and an extended configuration, shown in FIG. 5. The actuator first and second end portions 47 and 49 are closer to each other in the retracted configuration than in the extended configuration.

The base 25 includes a substantially elongated base guiding member, for example taking the form of a guiding rod 58. Typically, the guiding rods 58 extend between the anchoring wall 50 and a corresponding base frame end wall 28. The seat supporting assembly also includes a seat support-to-base linking member, for example taking the form of sliding cursors 56. The seat support-to-base linking member is operatively coupled to the seat support 36 and to the base guiding member with the seat support 36 being tiltable relatively to the base 25 and the seat support-to-base linking member being substantially longitudinally movable relatively to the base guiding member. In the specific embodiment of the invention shown in the drawings, two sliding cursors 56 are each slidably mounted on a corresponding guiding rod 58 extending, at least partially, longitudinally across the base frame 26. More specifically, as seen for example in FIG. 6, the sliding cursors 56 each includes a collar 57 defining a collar aperture 59, the guiding rods 58 being slidably mounted into the collar apertures 59.

As seen in FIGS. 6 and 7, each tilting member 60 defines a tilting member first end section 61, a substantially longitudinally opposed tilting member second end section 63 and a tilting member intermediate section 65 extending therebetween. Each tilting member intermediate section 65 defines a guiding groove 66 extending generally longitudinally relatively to the tilting member 60.

Each tilting member first end section 61 is pivotally attached to the seat support 36 in a substantially spaced apart relationship relatively to seat support-to-base linking member by a suitable tilting member-to-seat support pivotal link 64. The tilting member-to-seat support pivotal links 64 typically take the form of a corresponding pivoting axle extending between the tilting member 60 and a corresponding pivoting member 38.

Each tilting component second end section 63 is pivotally attached to the base frame 26 by a suitable tilting member-to-base frame pivotal link 62. The tilting member-to-base frame pivotal link 62 typically takes the form of a corresponding axle extending between the tilting member 60 and an adjacent base frame peripheral wall 30.

The actuating assembly 44 is operatively coupled to the base frame 26 and to the tilting members 60 for moving the seat supporting assembly 24 between the upright and tilted configurations. To that effect, the actuating assembly includes a motion transmitting member 68 mounted to the guiding groove 66 so as to be substantially slidably movable relatively thereto, the motion transmitting member 68 being movable relatively to the base along a predetermined path. In the embodiment of the invention shown in the drawings, the motion transmitting member 68 take the form of transmitting pins 68 and the predetermined path is substantially rectilinear and substantially parallel to the base guiding member 58. This allows to assemble a seat supporting assembly that is relatively simple and relatively compact.

In these embodiments, each guiding groove 66 is configured, sized and positioned for substantially fittingly and slidably receiving therein a corresponding transmitting pin 68. Each transmitting pin 68 is mechanically coupled to the actuating assembly frame 52. For example, each transmitting pin 68 extends from the actuating assembly frame 52. Typically, the transmitting pins 68 extend substantially laterally from the actuator mounting bracket 52 adjacent a corresponding longitudinal end thereof. Typically, the guiding slots 66 are formed on a corresponding inner surface of the motion converting component 60.

The configuration of the tilting member 60 and the manner in which it is coupled to the seat support 36, the actuating assembly 44 and the base 25 minimizes undesirable movements of the seat support 36 relatively to the base 25 that may caused by small spacings present between linked components, these small spacings being caused by manufacturing imperfections. This ensures a relatively smooth operation of the seat supporting assembly 24.

As illustrated more specifically in FIGS. 6 and 7, each guiding groove 66 is typically at least in part curved. For example, the guiding groove 66 has the general configuration of an arc segment. The guiding groove 66 is configured, sized and located so that the seat support-to-base angle 71 varies at a substantially constant angular speed as the seat supporting assembly 24 moves between the upright and tilted configurations in response to the motion transmitting member 68 moving at a substantially constant speed along the predetermined path. In other words, in the embodiment of the invention shown in the drawings, the configuration of the guiding groove 66 is designed so as to convert the linear movement of the linear-type actuator 46 into a pivoting movement of the seat support 36 with the pivoting speed of the seat support 36 remaining substantially constant throughout the pivoting range thereof as the linear-type actuator 46 translates at a relatively constant linear speed. In yet other words, the substantially arc-shape configuration of the guiding slots 66 provide a compensation for the change in the angular relationship between the seat support 36 and the base frame 26 such that the relatively constant translational movement of the linear-type actuator 46 is converted into a substantially constant speed rotational movement of the seat support 36.

In order to achieve such a compensation, the guiding groove 66 includes a substantially arc segment shaped portion. More specifically, in the specific embodiment of the invention shown in the drawings, the guiding groove 66 includes a guiding groove first section 69 located substantially adjacent the tilting member first end section 61 and a guiding groove second section 73 located substantially adjacent the tilting member second end section 63. The guiding groove first and second sections 69 and 73 are each substantially arc segment shaped and have respectively a first radius of curvature and a second radius of curvature, the second radius of curvature being substantially smaller than the first radius of curvature. The precise configuration of the guiding slots 66 could vary depending on the configuration and size of the other components of the seat supporting assembly and their respective relationship therebetween.

In some embodiments of the invention, the seat supporting assembly 24 is located, configured and sized so that a combined center of gravity of the seat supporting assembly 24, the seat 18 and the intended user (not shown) remains substantially within the sustentation polygon defined by the wheels 14 and 16 of the wheelchair 10 with the intended user sitting in the seat and the seat supporting assembly 24 being moved between the upright and tilted configurations. This is caused, at least in part, by the pivoting and slidable link between the seat support 36 and the base frame 26.

In use, moving each of the motion transmitting member, in other words the transmitting pins 68, along the predetermined path slides the motion transmitting member relatively to the guiding groove 66, which causes the seat supporting assembly 24 to move between the tilted and upright configurations by pivoting the tilting member 60 relatively to the seat support 36 and the base 25 and substantially simultaneously moving the seat support-to-base linking member 56 substantially longitudinally relatively to the base guiding member 58.

Although the present invention has been described hereinabove by way of preferred embodiments thereof, it can be modified, without departing from the spirit and nature of the subject invention as defined in the appended claims.

What is claimed is:

1. A seat supporting assembly for supporting a seat, said seat supporting assembly comprising:

a base, said base including a substantially elongated base guiding member;

a seat support for supporting the seat;

a seat support-to-base linking member, said seat support-to-base linking member being operatively coupled to said seat support and to said base guiding member with said seat support being tiltable relative to said base and said seat support-to-base linking member being substantially longitudinally movable relative to said base guiding member;

a substantially elongated tilting member defining a tilting member first end section, a substantially longitudinally opposed tilting member second end section and a tilting member intermediate section extending therebetween, said tilting member intermediate section defining a guiding groove extending generally longitudinally relative to said tilting member, said tilting member first end section being pivotally attached to said seat support in a substantially spaced apart relationship relative to seat support-to-base linking member, said tilting member second end section being pivotally attached to said base; and an actuating assembly operatively coupled to said base and to said tilting member for moving said seat supporting assembly between an upright configuration and a tilted configuration, a seat support-to-base angle between said seat support and said base being larger in said tilted configuration than in said upright configuration, said actuating assembly including a motion transmitting member mounted to said guiding groove so as to be substantially slidably movable relative thereto, said motion transmitting member being movable relative to said base along a predetermined path;

wherein moving said motion transmitting member along said predetermined path slides said motion transmitting member relative to said guiding groove, which causes said seat supporting assembly to move between said tilted and upright configurations by pivoting said tilting member relative to said seat support and said base and substantially simultaneously moving said seat support-to-base linking member substantially longitudinally relative to said base guiding member.

2. A seat supporting assembly as defined in claim 1, wherein said guiding groove is, at least in part, curved.

3. A seat supporting assembly as defined in claim 2, wherein said guiding groove is configured, sized and located so that said seat support-to-base angle varies at a substantially constant angular speed as said seat supporting assembly moves between said upright and tilted configurations in response to said motion transmitting member moving at a substantially constant speed along said predetermined path.

4. A seat supporting assembly as defined in claim 2, wherein said guiding groove includes a substantially arc segment shaped portion.

5. A seat supporting assembly as defined in claim 2, wherein said guiding groove includes a guiding groove first section located substantially adjacent said tilting member first end section and a guiding groove second section located substantially adjacent said tilting member second end section, said guiding groove first and second sections being each substantially arc segment shaped and having respectively a first radius of curvature and a second radius of curvature, said second radius of curvature being substantially smaller than said first radius of curvature, said guiding groove first and second sections being configured and sized such that continuous movement of said motion transmitting member therealong is uninterrupted as said motion transmitting member moves from one of said guiding groove first and second sections to the other one of said guiding groove first and second sections.

6. A seat supporting assembly as defined in claim 1, wherein said predetermined path is substantially rectilinear.

7. A seat supporting assembly as defined in claim 6, wherein said predetermined path is substantially parallel to said base guiding member.

8. A seat supporting assembly as defined in claim 1, wherein said actuating assembly includes an actuating assembly frame mounted to said base so as to be movable relative thereto over a substantially rectilinear path, said motion transmitting member being mechanically coupled to said actuating assembly frame.

9. A seat supporting assembly as defined in claim 8, wherein said actuating assembly includes a linear-type actuator having substantially opposed actuator first and second end portions, said actuator first and second end portions being attached respectively to said base and to said actuating assembly frame, said linear-type actuator being selectively movable between a retracted configuration and an extended configuration, said actuator first and second end portions being closer to each other in said retracted configuration than in said extended configuration.

10. A seat supporting assembly as defined in claim 1, wherein said motion transmitting member includes a transmitting pin substantially fittingly and substantially slidably mounted into said guiding groove.

11. A seat supporting assembly as defined in claim 1, wherein said base guiding member includes a rod and said seat support-to-base linking member includes a collar defining a collar aperture, said base guiding member being slidably mounted into said collar aperture.

12. A wheelchair for supporting an intended user, said wheelchair comprising:

a wheelchair frame;

at least three wheels rotatably mounted to said wheelchair frame;

a seat supporting assembly attached to said wheelchair frame, said seat supporting assembly including a base, said base including a substantially elongated base guiding member;

a seat support;

a seat support-to-base linking member, said seat support-to-base linking member being operatively coupled to said seat support and to said base guiding member with said seat support being tiltable relative to said base and said seat support-to-base linking member being substantially longitudinally movable relative to said base guiding member;

a substantially elongated tilting member defining a tilting member first end section, a substantially longitudinally opposed tilting member second end section and a tilting member intermediate section extending therebetween, said tilting member intermediate section defining a guiding groove extending generally longitudinally relative to said tilting member, said tilting member first end section being pivotally attached to said seat support in a substantially spaced apart relationship relative to seat support-to-base linking member, said tilting member second end section being pivotally attached to said base; and an actuating assembly operatively coupled to said base and to said tilting member for moving said seat supporting assembly between an upright configuration and a tilted configuration, a seat support-to-base angle between said seat support and said base being larger in said tilted configuration than in said upright configuration, said actuating assembly including a motion transmitting member mounted to said guiding groove so as to be substantially slidably movable relative thereto, said motion transmitting member being movable relative to said base along a predetermined path;

wherein moving said motion transmitting member along said predetermined path slides said motion transmitting member relative to said guiding groove, which causes said seat supporting assembly to move between said tilted and upright configurations by pivoting said tilting member relative to said seat support and said base and substantially simultaneously moving said seat support-to-base linking member substantially longitudinally relative to said base guiding member, and a seat mounted to said seat support.

13. A wheelchair as defined in claim 12, wherein said at least three wheels define a sustentation polygon and said seat supporting assembly is located, configured and sized so that a combined center of gravity of said seat supporting assembly, said seat and the intended user remains substantially within said sustentation polygon with the intended user sitting in said seat and said seat supporting assembly being moved between said upright and tilted configurations.

14. A tiltable seat assembly, said tiltable seat assembly comprising:

a seat supporting assembly, said seat supporting assembly including a base, said base including a substantially elongated base guiding member;

a seat support;

a seat support-to-base linking member, said seat support-to-base linking member being operatively coupled to said seat support and to said base guiding member with said seat support being tiltable relative to said base and said seat support-to-base linking member being substantially longitudinally movable relative to said base guiding member;

a substantially elongated tilting member defining a tilting member first end section, a substantially longitudinally opposed tilting member second end section and a tilting member intermediate section extending therebetween, said tilting member intermediate section defining a guiding groove extending generally longitudinally relative to said tilting member, said tilting member first end section being pivotally attached to said seat support in a substantially spaced apart relationship relative to seat support-to-base linking member, said tilting member second end section being pivotally attached to said base; and an actuating assembly operatively coupled to said base and to said tilting member for moving said seat supporting assembly between an upright configuration and a tilted configuration, a seat support-to-base angle between said seat support and said base being larger in said tilted configuration than in said upright configuration, said actuating assembly including a motion transmitting member mounted to said guiding groove so as to be substantially slidably movable relative thereto, said motion transmitting member being movable relative to said base along a predetermined path;

wherein moving said motion transmitting member along said predetermined path slides said motion transmitting member relative to said guiding groove, which causes said seat supporting assembly to move between said tilted and upright configurations by pivoting said tilting member relative to said seat support and said base and substantially simultaneously moving said seat support-to-base linking member substantially longitudinally relative to said base guiding member, and a seat mounted to said seat support.

15. A wheelchair as defined in claim 12, wherein said seat includes a seat frame defining a bench section and a backrest section, said seat support and said bench section being substantially adjacent and substantially parallel to each other.

16. A tiltable seat assembly as defined in claim 14, wherein said seat includes a seat frame defining a bench section and a backrest section, said seat support and said bench section being substantially adjacent and substantially parallel to each other.

17. A tiltable seat assembly, said tillable seat assembly comprising:

a seat including a seat frame defining a bench section and a backrest section, a seat supporting assembly, said seat supporting assembly including a base, said base including a substantially elongated base guiding member;

a seat support for supporting said seat, said seat support and said bench section being substantially adjacent and substantially parallel to each other;

a seat support-to-base linking member slidable along said base guiding member and pivotally supporting said seat support so that said seat support is pivotable relative to said base and movable therealong;

a substantially elongated tilting member defining a tilting member first end section, a substantially longitudinally opposed tilting member second end section and a tilting member intermediate section extending therebetween, said tilting member intermediate section defining a guiding groove extending generally longitudinally relative to said tilting member, said tilting member first end section being pivotally attached to said seat support in a substantially spaced apart relationship relative to seat support-to-base linking member, said tilting member second end section being pivotally attached to said base and fixed relative thereto; and an actuating assembly operatively coupled to said base and to said tilting member for moving said seat supporting assembly between an upright configuration and a tilted configuration, a seat support-to-base angle between said seat support and said base being larger in said tilted configuration than in said upright configuration, said actuating assembly including a motion transmitting member mounted to said guiding groove so as to be substantially slidably movable relative thereto, said motion transmitting member being movable relative to said base along a predetermined path;

wherein moving said motion transmitting member along said predetermined path slides said motion transmitting member relative to said guiding groove, which causes said seat supporting assembly to move between said tilted and upright configurations by pivoting said tilting member relative to said seat support and said base and substantially simultaneously moving said seat support-to-base linking member substantially longitudinally relative to said base guiding member, said seat being pivoted by using said actuating assembly to exert a pivoting force on said seat support at a location spaced apart from said seat support-to-base linking member.

* * * * *